US008109803B2

(12) United States Patent
Kichijo et al.

(10) Patent No.: US 8,109,803 B2
(45) Date of Patent: Feb. 7, 2012

(54) ASSEMBLING BLOCK

(75) Inventors: Hiroshi Kichijo, Oyodo (JP); Yoshiie Kichijo, Oyodo (JP)

(73) Assignee: Yoshiritsu Kabushiki Kaisha, Nara (JP)

( * ) Notice: Subject to any disclaimer, the term of this patent is extended or adjusted under 35 U.S.C. 154(b) by 514 days.

(21) Appl. No.: 12/227,213

(22) PCT Filed: May 22, 2007

(86) PCT No.: PCT/JP2007/060405

§ 371 (c)(1),
(2), (4) Date: Nov. 12, 2008

(87) PCT Pub. No.: WO2007/136047

PCT Pub. Date: Nov. 29, 2007

(65) Prior Publication Data

US 2009/0092774 A1 Apr. 9, 2009

(30) Foreign Application Priority Data

May 24, 2006 (JP) ..... 2006-144441
Aug. 7, 2006 (JP) ..... 2006-214401
Mar. 8, 2007 (WO) ..... PCT/JP2007/054546

(51) Int. Cl.
*A63H 33/08* (2006.01)

(52) U.S. Cl. ..... 446/109; 52/177; 52/582.1; 446/111; 446/122; 428/33

(58) Field of Classification Search ..... 446/108, 446/109, 111–116, 122; 52/177, 390, 392, 52/533, 534, 539, 553, 578, 582.1, 586.1, 52/586.2, 588.1, 589.1, 590.2, 590.3, 591.1, 52/591.2, 591.3, 591.4, 591.5, 592.1, 582.2, 52/582.4, 745.08, 745.19, 747.1, 747.11, 52/748.1, 748.11; 403/334, 345, 364–368, 403/372, 375, 376, 381; 404/34, 35, 40, 404/41, 46, 47, 49–58, 68, 70; 428/44, 47–50, 428/57, 58, 60, 61, 106, 192–194, 33
See application file for complete search history.

(56) References Cited

U.S. PATENT DOCUMENTS 2,909,867 A * 10/1959 Hobson ..... 446/116
(Continued)

FOREIGN PATENT DOCUMENTS

CN 2292590 9/1998
(Continued)

OTHER PUBLICATIONS

Supplemental European Search Report, issued Jun. 30, 2010 in EP application 07 74 3839, which is a counterpart to the present application.
Chinese Office Action issued Mar. 1, 2010 in corresponding Chinese Application No. 2007800184624 (with translation).
International Search Report issued Jun. 19, 2007 in the International (PCT) Application of which the present application is the U.S. National Stage.

*Primary Examiner* — William Gilbert
(74) *Attorney, Agent, or Firm* — Wenderoth, Lind & Ponack, L.L.P.

(57) ABSTRACT

An assembling block includes block plates having square and equilateral triangular plan shapes, respectively, and a joint for connecting the block plates together. Each of the block plates includes seat portions provided along the respective sides of the block plate, and retaining pieces extending from the center of the block plate to the outer edge thereof and spaced from the seat portions in the thickness direction. The joint comprises a plate member made of a flexible and bendable material, whereby when the joint is inserted between two of the seat portions and one of the retaining pieces of each block plate, the joint engages the seat portions with engaging protrusions formed on the seat portions fitted in engaging holes formed in the joint, thereby coupling the block plates together.

6 Claims, 15 Drawing Sheets

U.S. PATENT DOCUMENTS

| | | | | | |
|---|---|---|---|---|---|
| 3,855,748 | A | * | 12/1974 | Thomas | 52/578 |
| 4,365,454 | A | * | 12/1982 | Davis | 52/578 |
| 5,482,491 | A | * | 1/1996 | Kichijyo | 446/112 |
| 5,487,690 | A | | 1/1996 | Stoffle et al. | |
| 5,664,387 | A | * | 9/1997 | Bhatti | 52/604 |
| 5,678,946 | A | | 10/1997 | Enami | |
| D425,138 | S | * | 5/2000 | Haddad | D21/480 |
| 6,068,533 | A | * | 5/2000 | Glickman et al. | 446/111 |
| 6,500,007 | B2 | * | 12/2002 | Pupulin | 434/171 |
| 6,718,709 | B2 | * | 4/2004 | Koutras et al. | 52/285.1 |
| 2002/0065018 | A1 | * | 5/2002 | Huang | 446/112 |
| 2003/0077975 | A1 | * | 4/2003 | Barringer et al. | 446/108 |
| 2007/0054588 | A1 | * | 3/2007 | Gastaldi | 446/108 |

FOREIGN PATENT DOCUMENTS

| | | |
|---|---|---|
| DE | 77 40 304 | 7/1978 |
| EP | 1 642 630 | 4/2006 |
| FR | 2 656 387 | 6/1991 |
| JP | 55-65098 | 5/1980 |
| JP | 8-049709 | 2/1996 |
| JP | 3221637 | 8/2001 |

OTHER PUBLICATIONS

* cited by examiner

ASSEMBLING BLOCK

TECHNICAL FIELD

This invention relates to an assembling block which can be coupled to other such blocks one after another to construct a three-dimensional object.

BACKGROUND ART

The present applicant proposed, based on the invention disclosed in JP Patent publication 3221637B, an assembling block comprising block plates having square and equilateral triangular plan shapes, and a joint for coupling the block plates together.

The block plates and the joint of this assembling block are formed by molding a hard plastic material. An insertion opening is formed along each side of the block plates. The joint has plugs extending in at least two directions and adapted to be received in the insertion openings.

Different types of joints are prepared which are coupled to block plates in different ways. These joints include one having plugs that are flush with each other and extend in two directions, one having plugs extending in two directions that intersect each other at a right angle, one having plugs extending in three directions that intersect each other at right angles, one having plugs extending in two directions at an angle of 120°, and one having plugs of which the distances between their proximal ends are different from each other.

SUMMARY OF THE INVENTION

In this assembling block, because the coupling angle between the block plates and the number of block plates that can be coupled together are limited according to the type of the joint used, variation in shape of constructed joints is limited even if many different kinds of joints are prepared.

In order to maintain the strength of fitting between the plugs of the joint and the insertion openings of the block plates, high dimensional accuracy is required. Thus, strict dimensional control is required for the end product, which adds to the manufacturing cost.

An object of the present invention is therefore to provide an assembling block which makes it possible to easily assemble many differently shaped objects using minimum kinds of joints and which can be manufactured at a low cost.

In order to achieve this object, this invention provides an assembling block comprising block plates having square and equilateral triangular plan shapes, respectively, and a joint for connecting the block plates together, wherein each of the block plates includes seat portions provided along the respective sides of the block plate, and retaining pieces extending from the center of the block plate to the outer edge thereof and spaced from the seat portions in the thickness direction, and wherein the joint comprises a plate member made of a flexible and bendable material, whereby when the joint is inserted between two of the seat portions and one of the retaining pieces of each block plate, the joint engages the two of the seat portions or the one of the retaining pieces, thereby coupling the block plates together through the joint.

In one arrangement, a plurality of the joints can be stacked one on another and inserted between two of the seat portions and one of the retaining pieces of each block plate.

In another arrangement, a protrusion is formed on one of the joint and each seat portion or each retaining piece of each block plate, and is adapted to be engaged in an engaging hole formed in the other, thereby bringing each block plate into engagement with the joint.

In still another arrangement, a pocket (11) is formed on each corner of the block plates (1) into which a shoulder (2*a*) of the joint (2) can be inserted to stabilize the joint.

From another aspect of the invention, the present invention provides an assembling block of the above type wherein each of the block plates comprises two separate plates stacked one on the other and integrated with each other, thereby defining insertion spaces therebetween that open to the respective sides of the block plate, and that the joint comprises a plate member made of a flexible and bendable material, whereby when the joint is inserted into one of the insertion spaces of each block plate, the joint engages the edge of the one of the insertion spaces, thereby coupling the block plates together through the joint.

In one arrangement, a plurality of the joints can be stacked one on another and inserted into any of the insertion spaces of each block plate.

In another arrangement, an engaging protrusion is formed on the edge of each insertion space of each block plate, and is adapted to be engaged in an engaging hole formed in the joint, thereby bringing each block plate into engagement with the joint.

According to the intended use, the block plates may be formed by molding a plastic material, or by pressing a metal plate.

Using this assembling block, it is possible to form surfaces that form any desired angle relative to each other by bending the joint at any desired angle. By inserting a plurality of such joints between any two seat portions and any one retaining piece of the block plate, and bending the individual joints at different angles from each other, block plates can be coupled to the respective joints so as to extend in a plurality of different directions from each other.

It is therefore possible to assemble various three-dimensional objects without preparing many kinds of joints. No strict dimensional control is necessary either. Thus, such three-dimensional objects can be manufactured at a low cost.

The assembling blocks according to the present invention can be used not only as toys, but to assemble other practical articles such as handicrafts, decorations, and shades for lighting devices. Also, using large and high-strength block plates and joints, it is possible to assemble a large structure such as a building or a vehicle.

The joint can be easily pulled out from between the seat portions and the retaining piece by deflecting and disengaging the joint from the seat portions or the retaining piece. A three-dimensional object assembled from the assembling blocks according to the present invention can thus be easily disassembled.

DETAILED DESCRIPTION OF THE INVENTION

The first embodiment of this invention is now described with reference to FIGS. 1 to 4.

Figure 1:
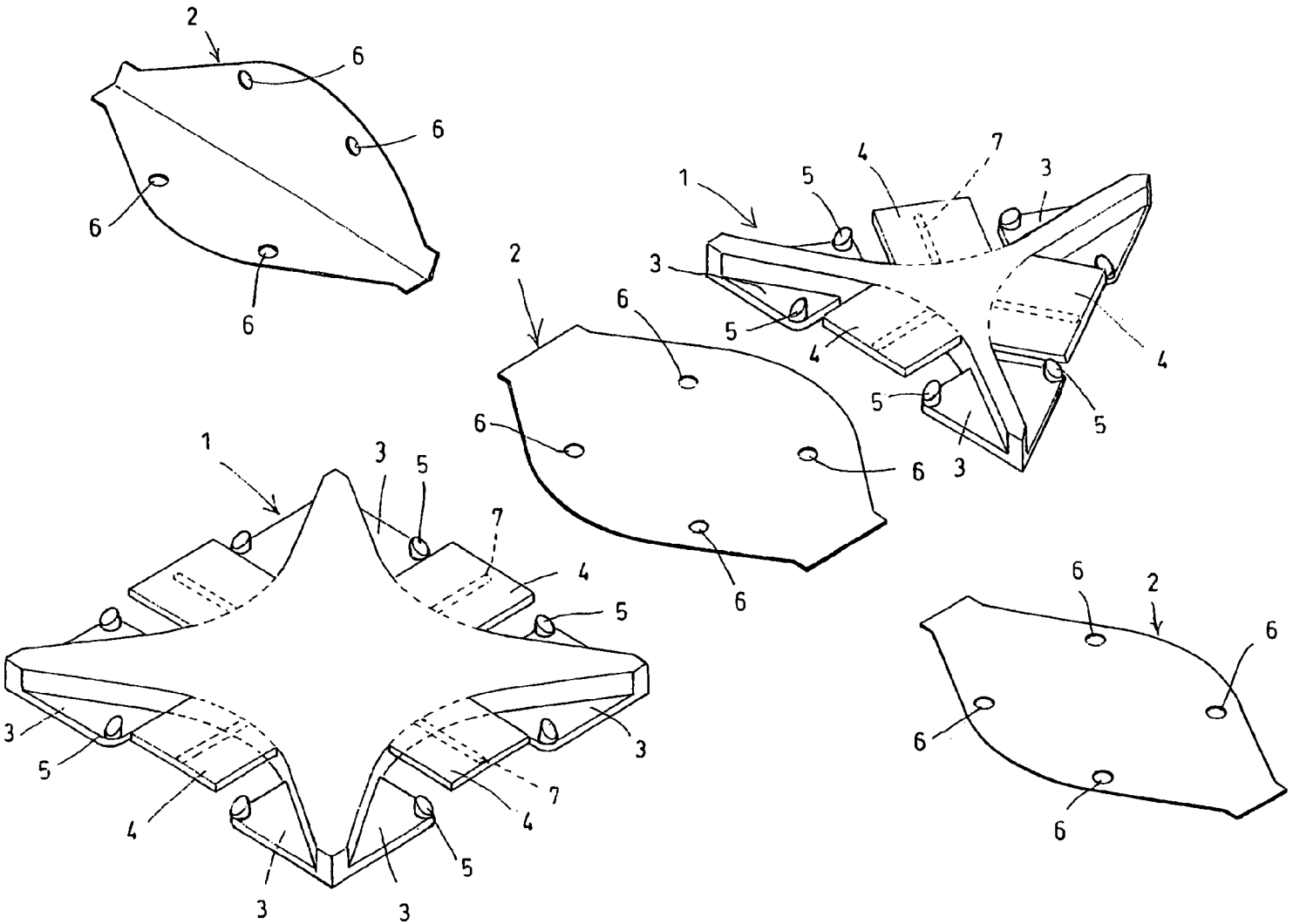
FIG. 1 is a perspective view of block plates and joints according to a first embodiment.

As shown in FIG. 1, this assembling block comprises block plates 1 which are in the shape of an equilateral triangle and a square, respectively, as viewed from above, and joints 2 through which the block plates 1 are coupled together. The block plates 1 are hard members formed by molding a plastic material such as acrylic resin in a mold. The block plates 1 have sides that are equal in length to each other and thicknesses that are also equal to each other.

Each block plate 1 includes seat portions 3 provided along the respective sides of the block plate, and retaining pieces 4 extending from the center of the block plate to the outer edge thereof and spaced from the seat portions 3 in the thickness direction. The seat portions 3 are provided at both ends of the respective sides so as to be spaced from each other. Each seat portion 3 has a step in its inner portion and is formed with an engaging protrusion 5 on its seating surface.

The joints 2 are formed by stamping a flexible and bendable plastic plate and shaped such that their side edges bulge at their central portions. Through the bulging portion of each joint 2, two circular engaging holes 6 are formed so as to be spaced from each other along each side edge.

The joints 2 include one of a basic shape, i.e. a narrow flat one, one bent beforehand along a central bending line at an angle of 120°, and one that is wider than the one of a basic shape.

Figure 2:
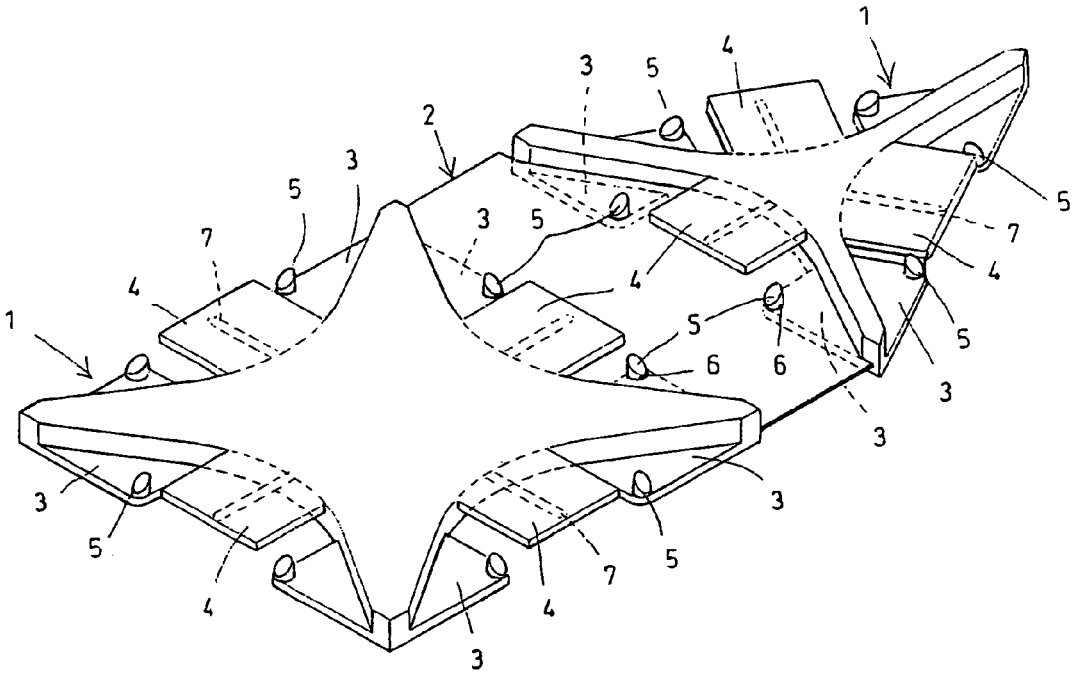
FIG. 2 is a perspective view of the same, showing how they are coupled together.

In this assembling block, in order to couple the block plates 1 together through one of the joints 2, as shown in FIGS. 1 and 2, the side edges of the joint 2 are inserted between seat portions 3 and retaining pieces 4 of the respective block plates 1.

In this state, when the joint 2 is elastically deformed and then elastically return to the original state, the engaging protrusions 5 are engaged in the engaging holes 6, thereby bringing the seat portions 3 into engagement with the joint 2, and thus coupling the block plates 1 together.

Also in this state, the side edges of the joint 2 abut the steps of the respective seat portions 3, thereby preventing shifting of the joint 2 relative to the block plates 1.

Figure 3:
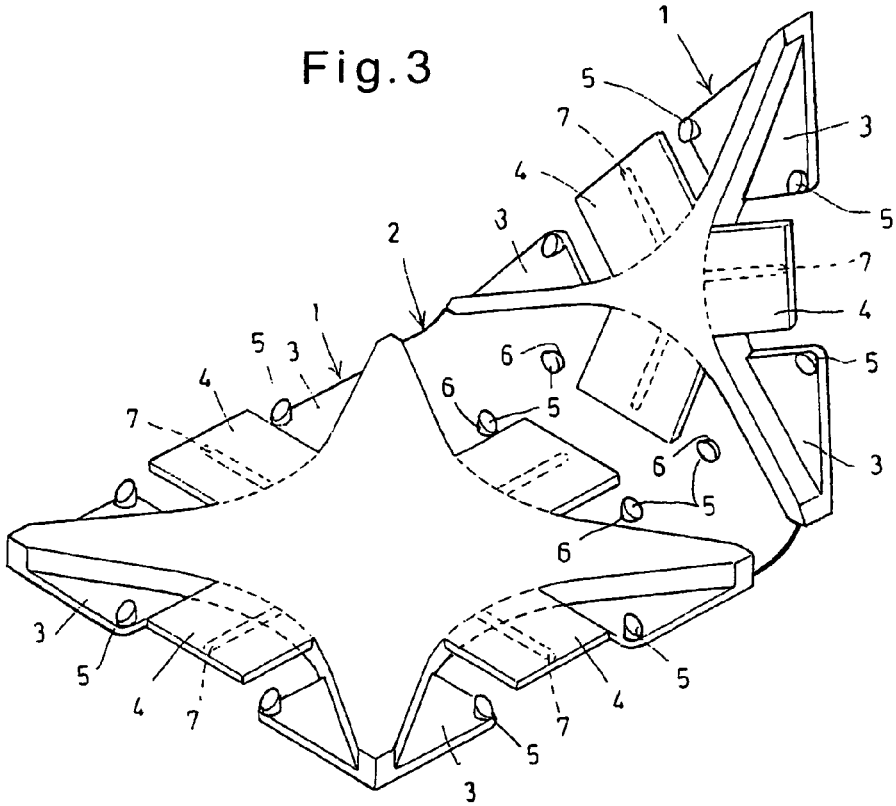
FIG. 3 is a perspective view of the same, showing how the joint is bent.

With the block plates 1 coupled together through the joint 2 in the manner described above, by bending the joint 2 to a desired degree as shown in FIG. 3, the surfaces of the block plates can be bent at any desired angle relative to each other.

Figure 4:
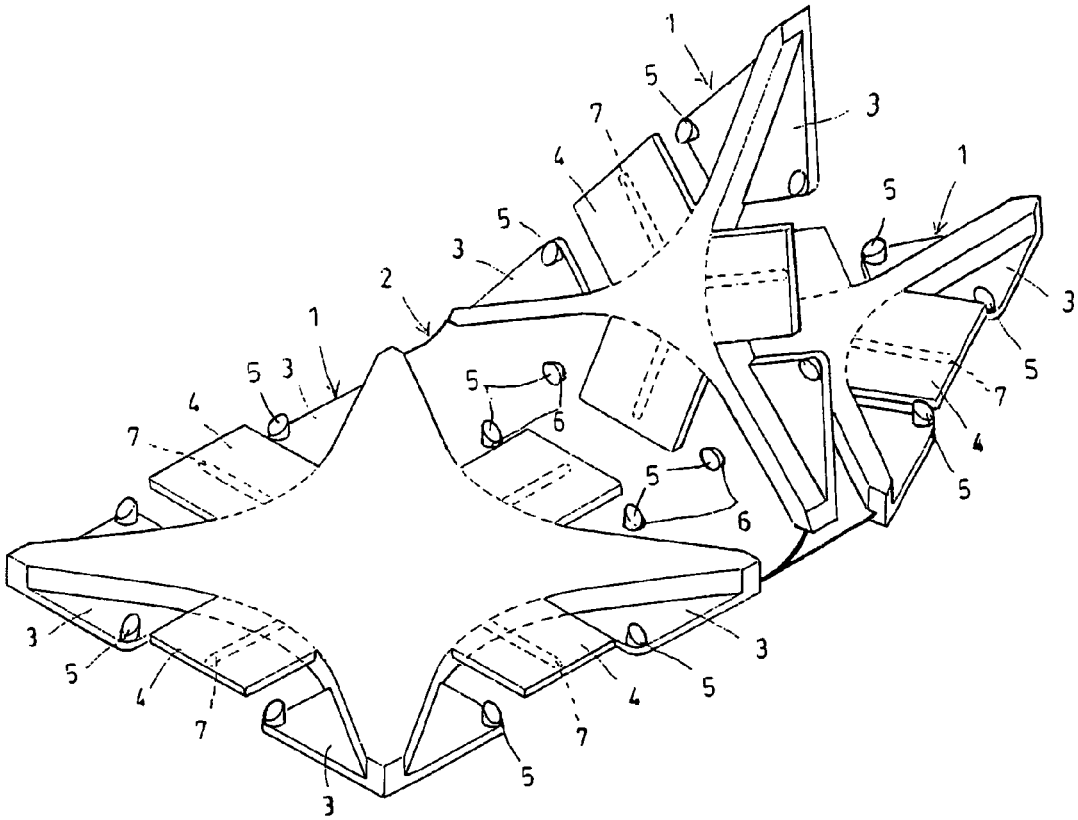
FIG. 4 is a perspective view showing how they are coupled together in three directions.

As shown in FIG. 4, by inserting a plurality of joints 2 between seat portions 3 and the corresponding retaining piece 4 of one block plate 4, it is possible to couple a plurality of block plates 1 to this block plate 1 so as to extend in different directions from each other.

On the back of each retaining piece 4, a rib 7 is formed which serves to reliably retain even one joint 2 between the seat portions 3 and the retaining piece 4, thereby stably keeping the block plates 1 coupled together.

The engaging protrusions 5 have their tops cut obliquely so that they are lower in height at their portions near the outer edge of the block plate. The seat portions 3 and the retaining pieces 4 have their end edges tapered so as to retract toward their sides into which the joint is inserted. Thus, the joint 2 can be smoothly inserted between the seat portions 3 and the retaining piece 4 of the block plate 1.

Figure 5:
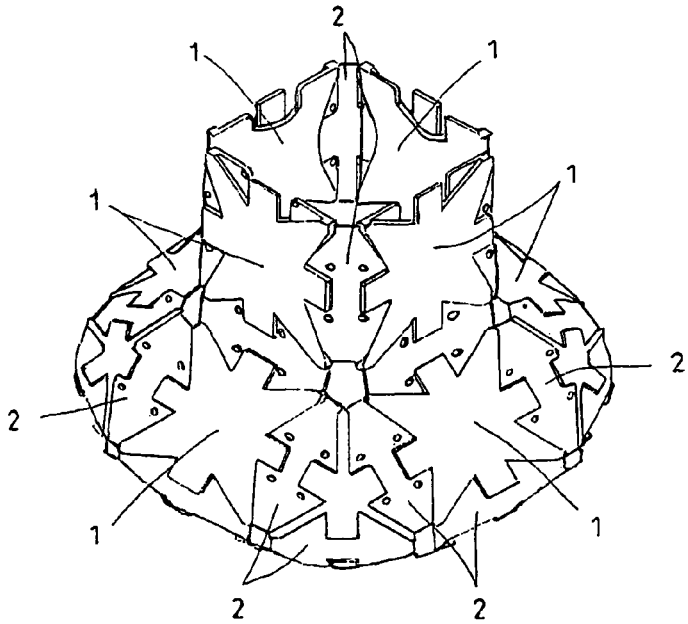
FIG. 5 is a perspective view of a jar-shaped vessel formed from assembling blocks of the invention.

By using such assembling blocks, it is possible to form three-dimensional objects of various surface configurations, such as a jar-shaped vessel as shown in FIG. 5, by suitably combining and coupling square and equilateral triangular block plates 1 through the joints 2 at any desired angle. The respective block plates 1 and the joints 2 may be transparent or colored for diversity in design.

Figure 6:
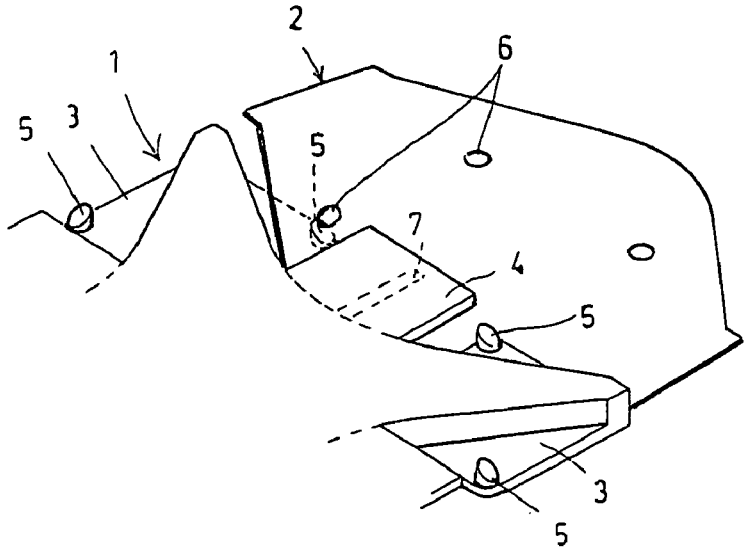
FIG. 6 is a perspective view of a block plate and a joint, showing how they are uncoupled from each other.

As shown in FIG. 6, by deflecting the joint 2, the engaging protrusions 5 can be easily disengaged from the engaging holes 6, and then the joint 2 can be easily pulled out from between the seat portions 3 and the retaining piece 4 of the block plate 1. Thus, any three-dimensional object assembled from the assembling blocks of the present invention can be easily disassembled and then the blocks can be easily reassembled into a different three-dimensional object.

Figure 7:
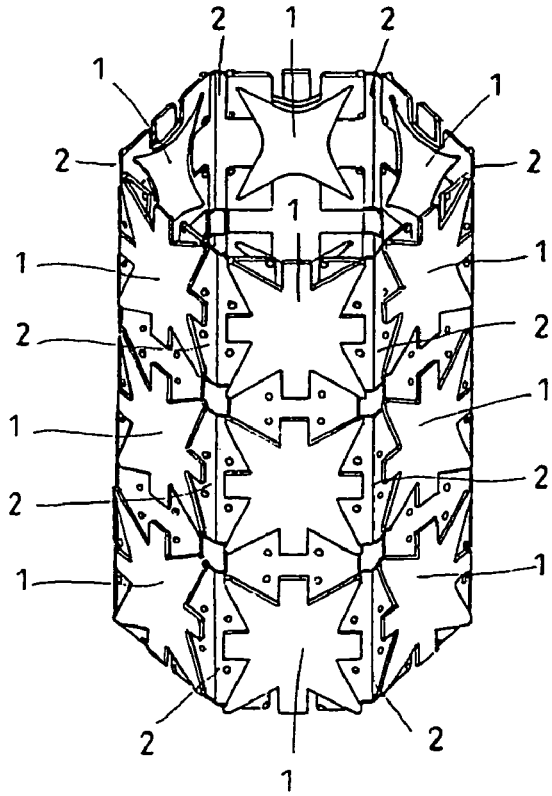
FIG. 7 is a perspective view showing how joints are bent at an angle of 120° in use.

In order to assemble a hexagonal tube shown in FIG. 7, joints 2 of the type that are bent beforehand along a central bending line at an angle of 120° are preferably used as the joints provided along the ridgelines of the hexagonal tube so that such a hexagonal tube can be easily assembled.

Figure 8:
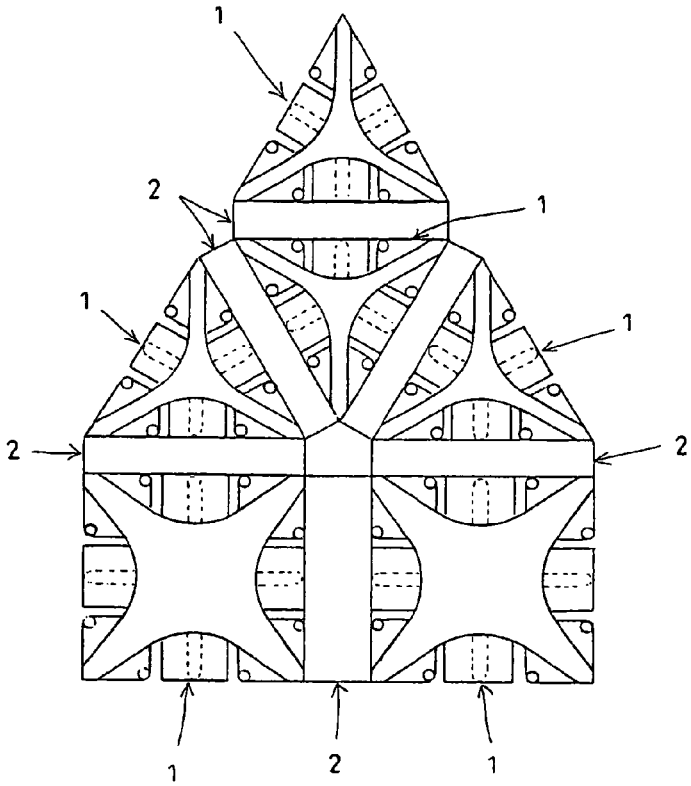
FIG. 8 is a perspective view showing how wide joints are used.

As shown at the lower portion of FIG. 8, where there is a large space between adjacent block plates 1, a wide joint 2 should be used.

Figure 9:
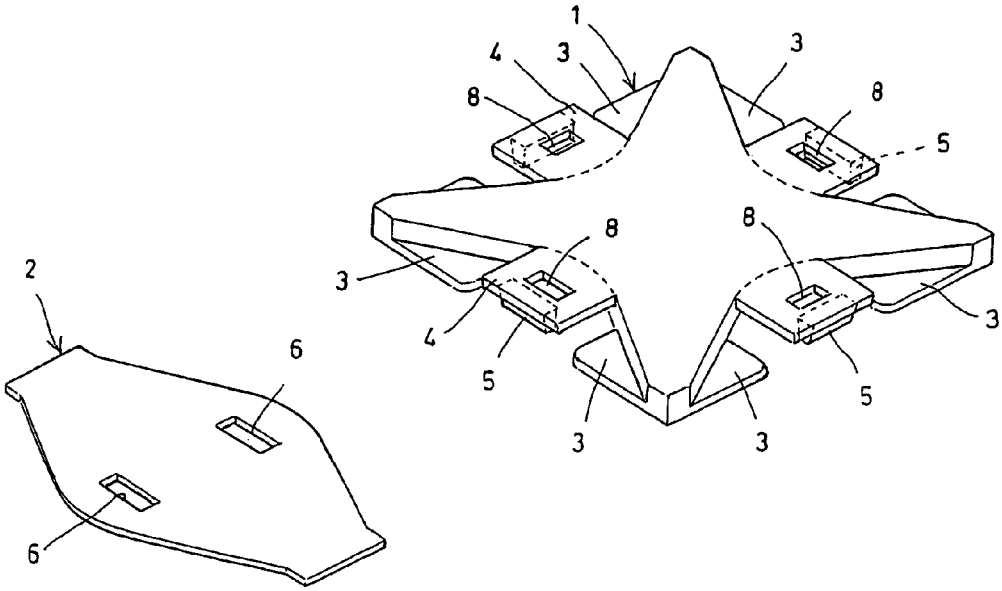
FIG. 9 is a perspective view of a block plate and a joint according to a second embodiment.

In the first embodiment, an engaging protrusion 5 is provided on each seat portion 3 of the block plate 1. In the second embodiment shown in FIG. 9, an engaging protrusion 5 is provided on the back of each retaining piece 4, engaging holes 6 are formed in the central portion of the joint 2 on both sides thereof so as to correspond to the respective engaging protrusions 5, and each retaining piece 4 is formed with a hole 8 for disassembling through which a screwdriver or any other tool can be inserted to deflect the joint 2.

Figure 10:
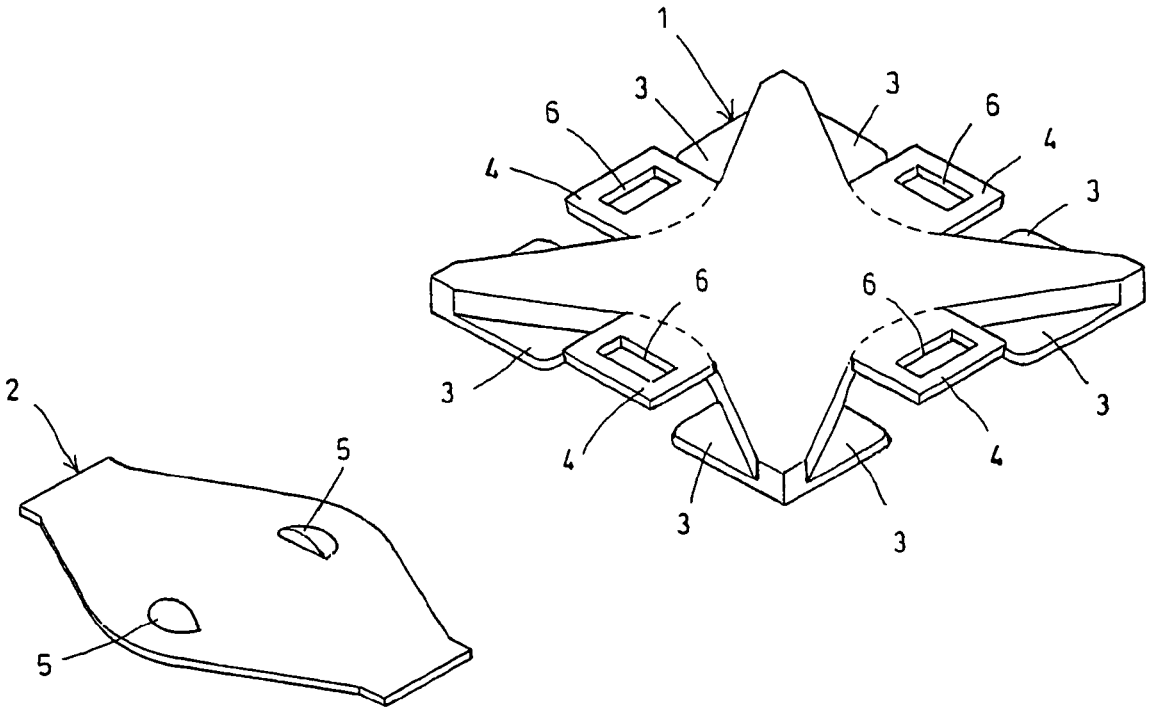
FIG. 10 is a perspective view of a block plate and a joint according to a third embodiment.

In the third embodiment shown in FIG. 10, engaging protrusions 5 are formed on the joint by bulging e.g. by pressing, and engaging holes 6 are formed in the block plate 1. In this case, the engaging holes 6 are formed in the retaining pieces 4 or the seat portions 3 according to the positions of the engaging protrusions 5.

Figure 11:
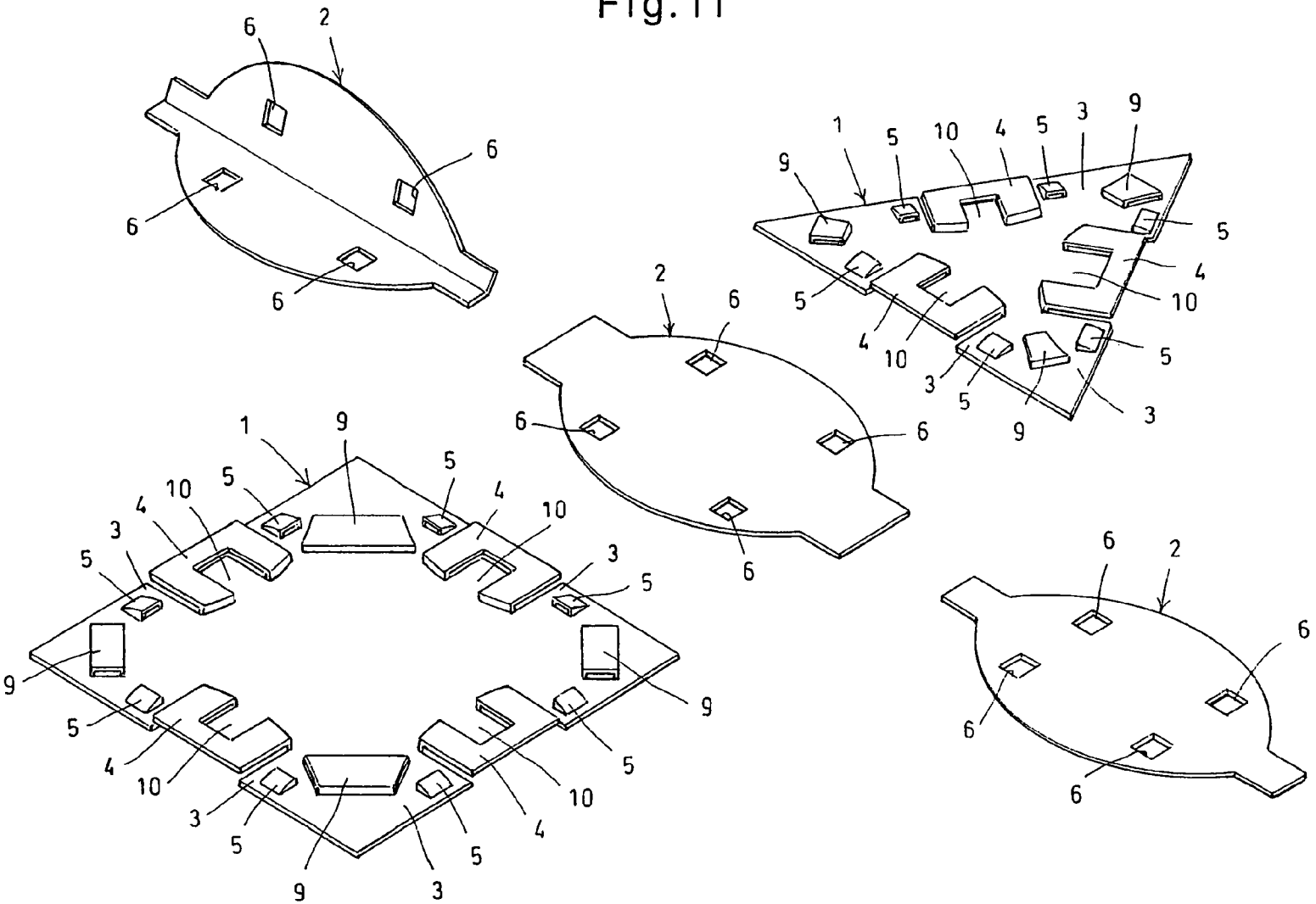
FIG. 11 is a perspective view of block plates and joints according to a fourth embodiment.

In the first to third embodiments, the elements of the assembling block are made of a plastic material. But if the assembling blocks according to the present invention are used to manufacture a large structure for which strength and durability are required, such as a building or a vehicle, they may be formed of metal plates such as stainless steel plates, as in the fourth embodiment shown in FIG. 11.

The block plates 1 of this embodiment are each formed by pressing a metal plate formed with cuts to raise the retaining pieces 4 from the seat portions 3, and by bulging the seat portions 3 to form the engaging protrusions 5. Further, stoppers 9 are formed at the respective corners for abutting and positioning the joint 2 when the joint 2 is inserted between the seat portion 3 and the retaining piece 4. A support piece 10 for preventing deflection of the joint 2 is formed by cutting each retaining piece 4 so as to be flush with the seat portions 3. The joint 2 is formed by stamping a metal plate.

Figure 12:
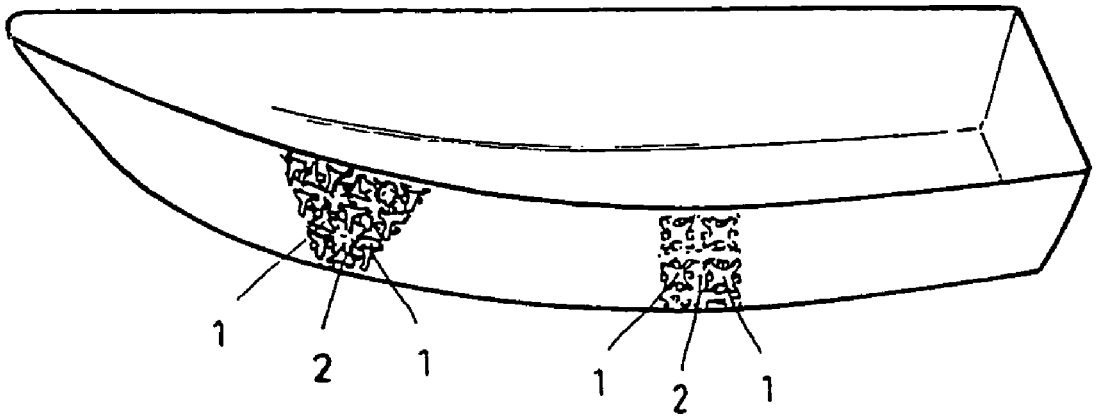
FIG. 12 is a perspective view of a boat formed from assembling blocks according to the present invention.

Such assembling blocks can be used to construct a building or the like, or a boat as shown in FIG. 12. In the latter case, in order to provide watertightness, any gap should be closed by a filler, and a waterproof sheet should be stuck on the surface of the boat.

Figure 13:
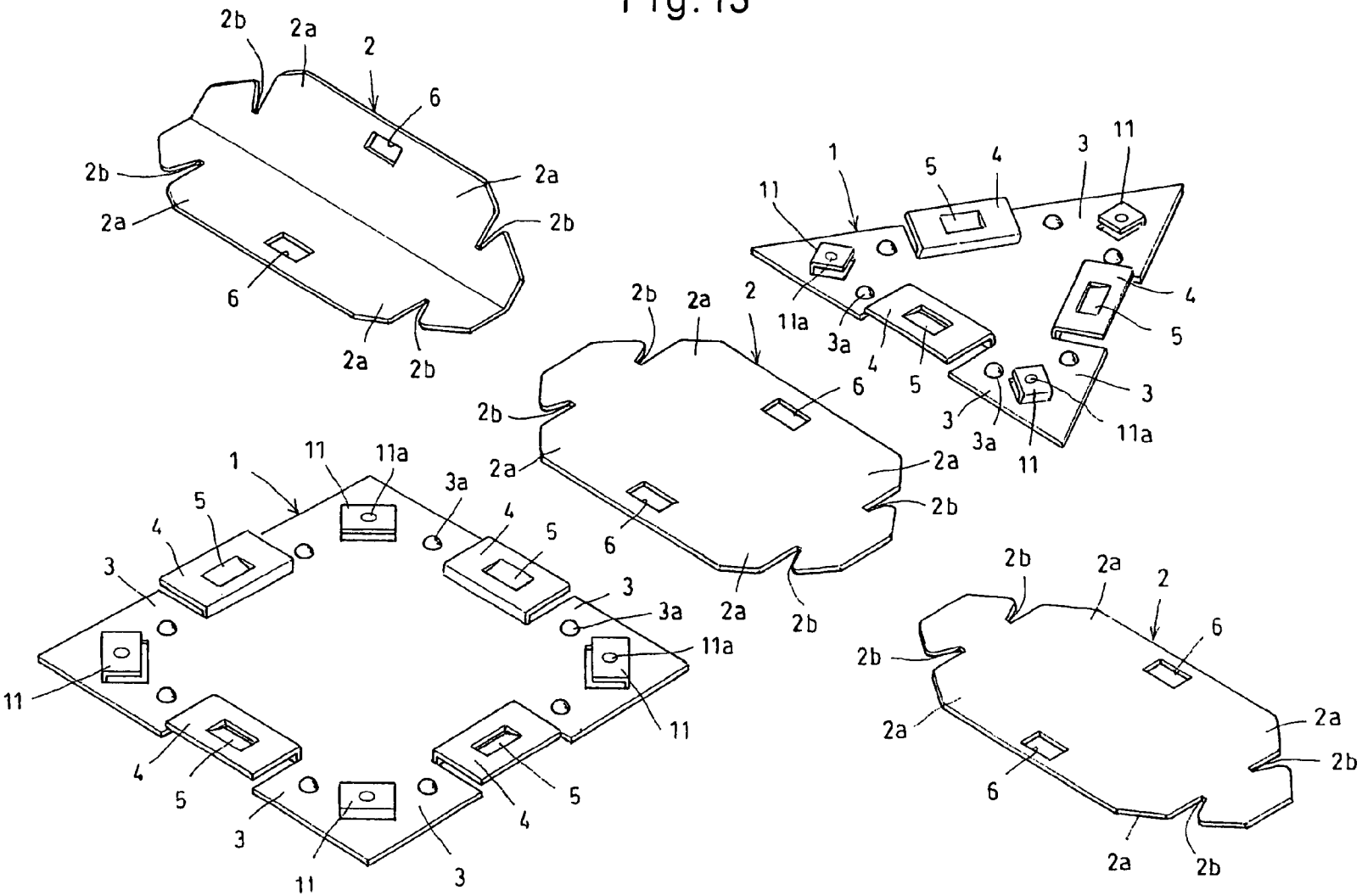
FIG. 13 is a perspective view of block plates and joints according to a fifth embodiment.

FIG. 13 shows a fifth embodiment, which is also an assembling block made of a metal. In this embodiment, an engaging protrusion 5 is formed on the back of each retaining piece 4, and a pocket 11 is formed on the corner of each seat portion 3. Pressing protrusions 3*a* and 11*a* are formed on the surface of each seat portions 3 and on the back of the pocket 11, respectively. The joint 2 has, on each side thereof, a pair of shoulders 2*a* and a pair of constricted portions 2*b*.

Figure 14:
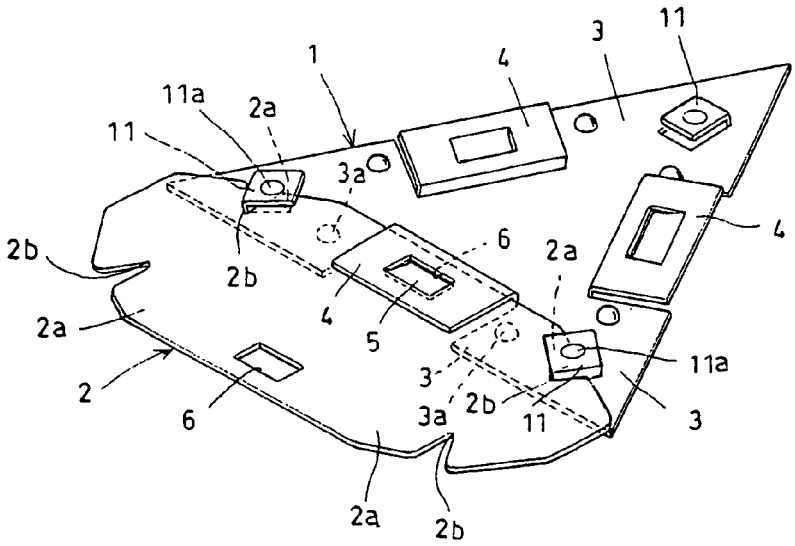
FIG. 14 is a perspective view of the same, showing how they are coupled together.

In this assembling block, as shown in FIG. 14, when the joint 2 is inserted between the seat portions 3 and the retaining piece 4, the engaging protrusion 5 engages in the corresponding engaging hole 6, and simultaneously, the shoulders 2*a* of the joint 2 are inserted into the respective pockets 11 of the block plate 1, thereby preventing turning up of the joint 2. Also simultaneously, the constricted portions 2*b* engage the ends of the respective pockets 11, and the pressing protrusions 3*a* and 11*a* sandwich the joint 2, thereby preventing rattling of the joint 2, which in turn makes it possible to construct a rigid structure of which the shape is stably maintained.

In order to separate the block plate 1 and the joint 2 from each other, the coupled portion is bent to push up the retaining piece 4 away from the seat portions 3, thereby disengaging the engaging protrusions 5 from the engaging holes 6. In this state, the joint 2 can be easily pulled out from between the seat portions 3 and the retaining piece 4 of the block plate 1. Thus, any three-dimensional object assembled from the assembling blocks of this embodiment can be easily disassembled and the assembling blocks can then be easily reassembled into a different three-dimensional object.

Figure 15:
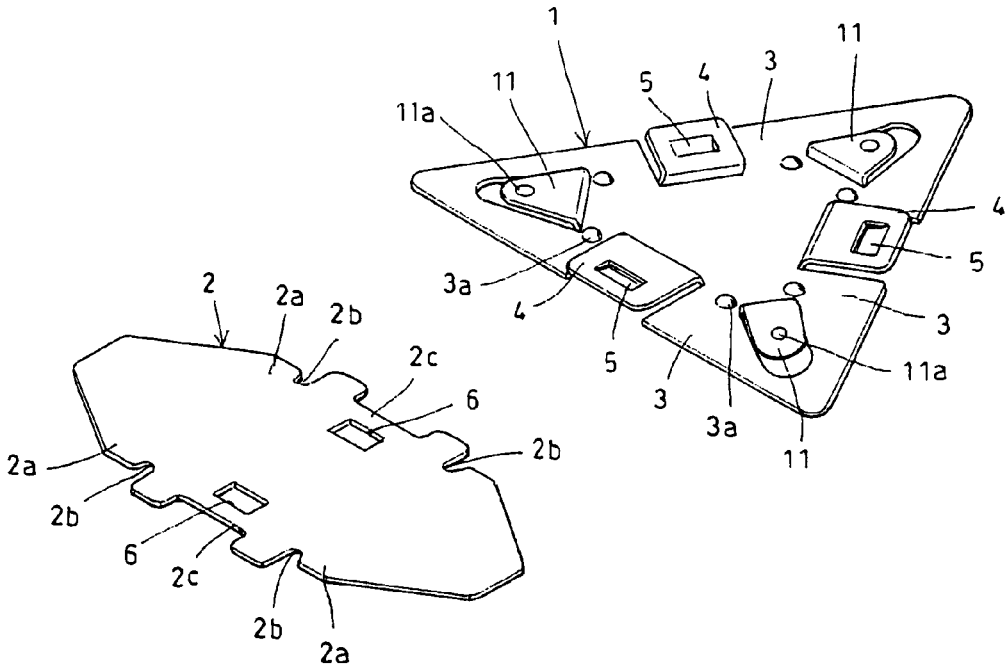
FIG. 15 is a perspective view of a block plate and a joint according to a sixth embodiment.
Figure 16:
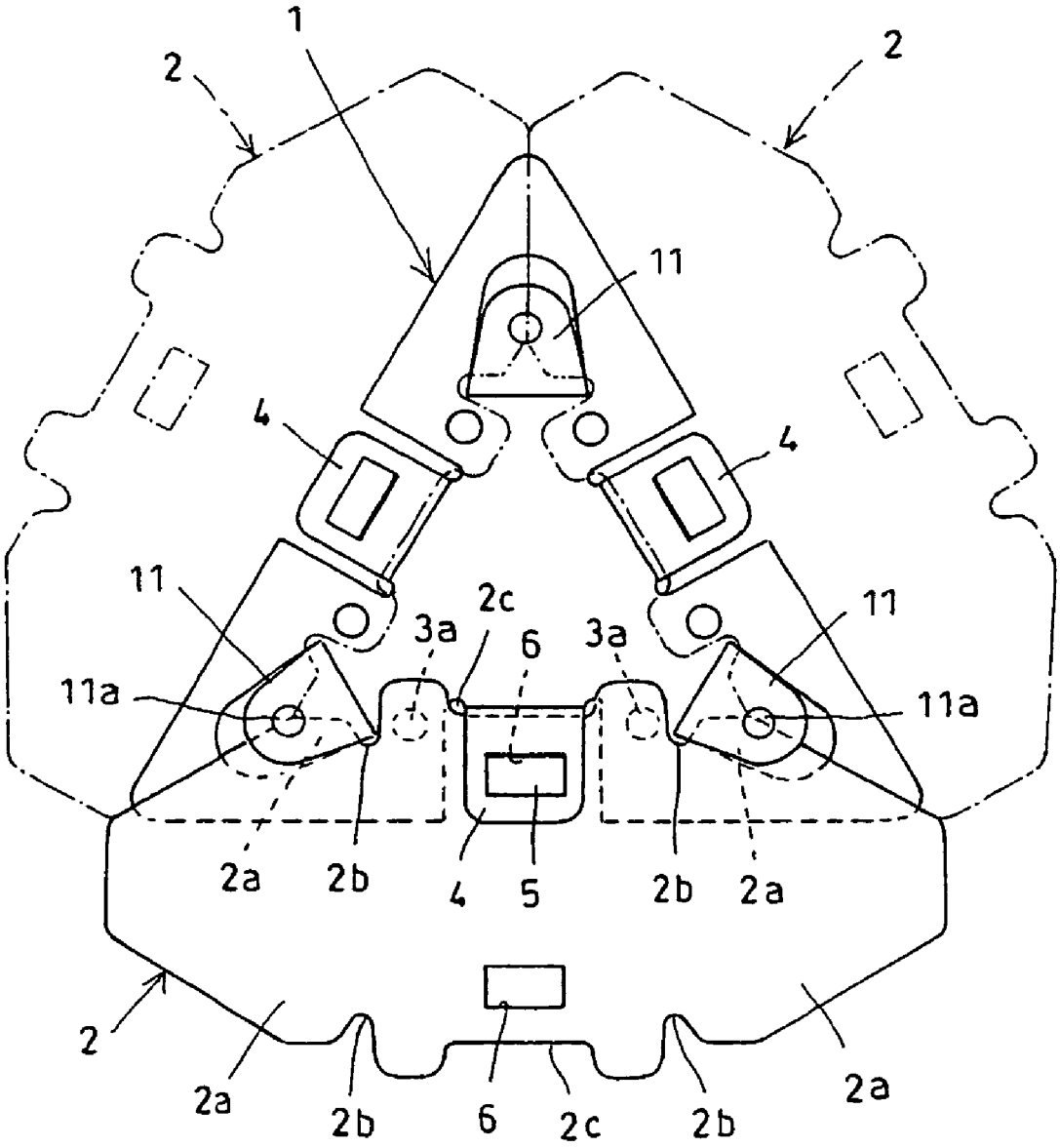
FIG. 16 is a plan view of the same, showing how they are coupled together.

In the sixth embodiment shown in FIGS. 15 and 16, the joint 2 has engaging recesses 2*c* on both sides thereof at its central portion. One of the recesses 2*c* is adapted to engage the corresponding retaining piece 4 at its root, thereby stabilizing the joint 2. For increased strength of the block plate 1, the leg of each pocket 11, which is formed by cutting the block plate and raising the cut portion, is preferably located inside the block plate 1.

Figure 17:
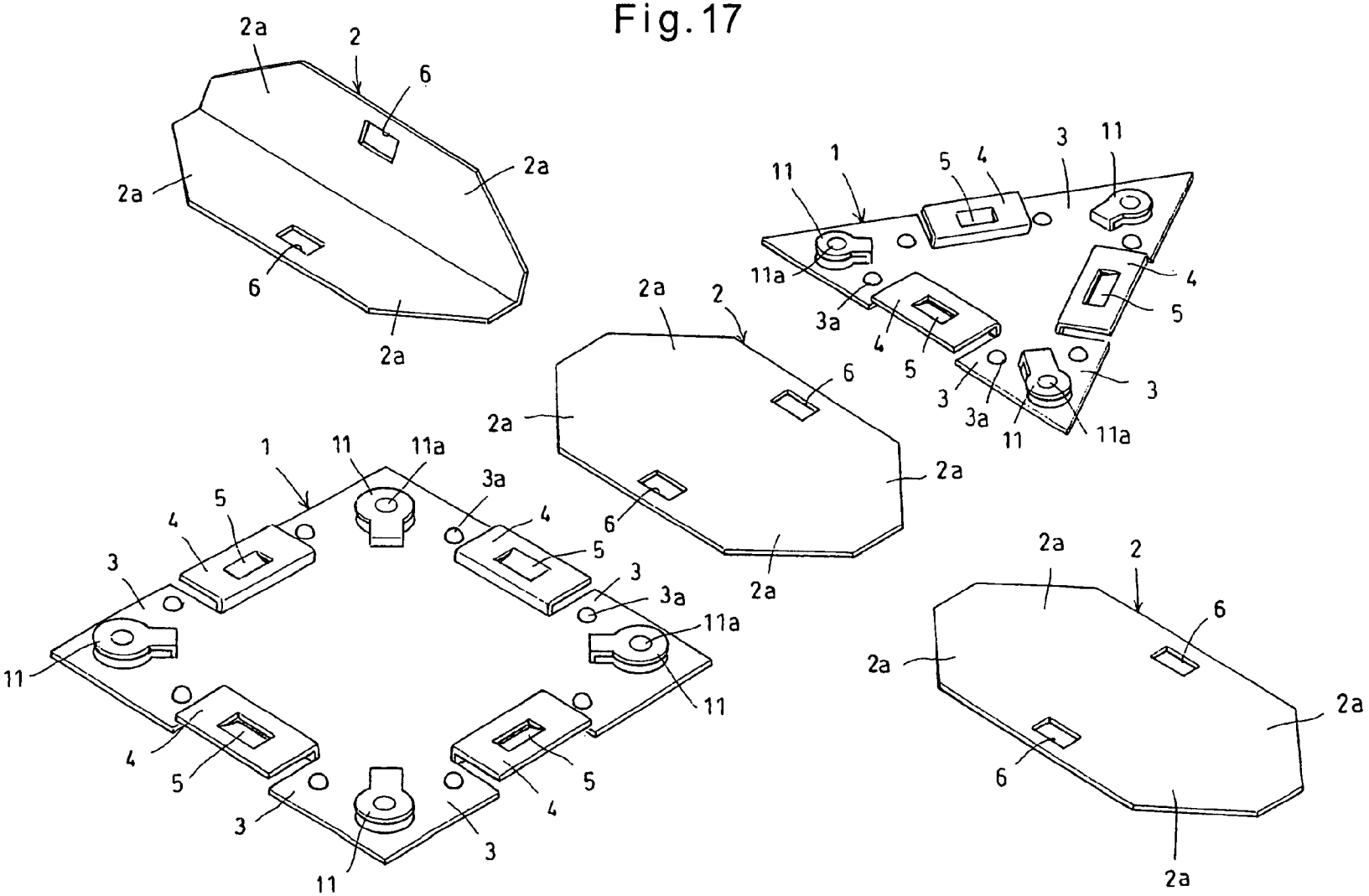
FIG. 17 is a perspective view of block plates and joints according to a seventh embodiment.
Figure 18:
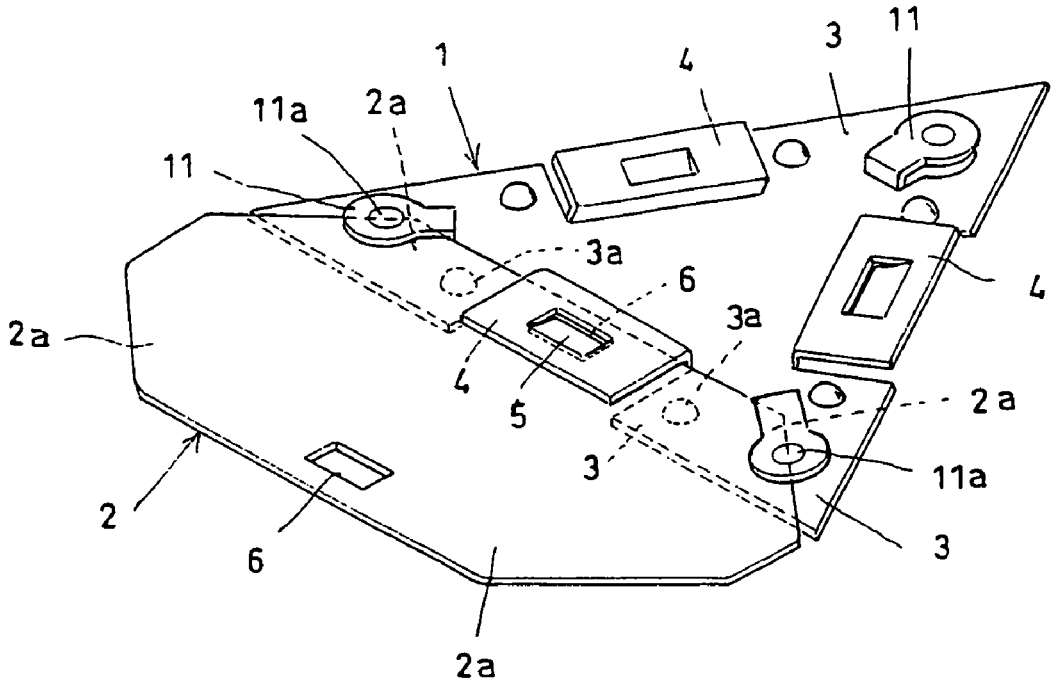
FIG. 18 is a plan view of the same, showing how they are coupled together.

Depending upon the material and dimensions of the assembling block, if the joint 2 does not rattle at all or scarcely rattles, not only the recesses 2*c* but the constricted portions 2*b* may be omitted, as in the seventh embodiment shown in FIGS. 17 and 18.

In the embodiments of the blocks made of a metal, the engaging protrusions 5 are formed on the block plate 1 and the engaging holes 6 are formed in the joint 2. But conversely, the engaging protrusions 5 may be formed on the joint 2 with the engaging holes 6 formed in the block plate 1.

The pockets 11 may be formed not only on blocks made of a metal, but on blocks made of a plastic material in order to prevent turning up of the joint 2.

Figure 19:
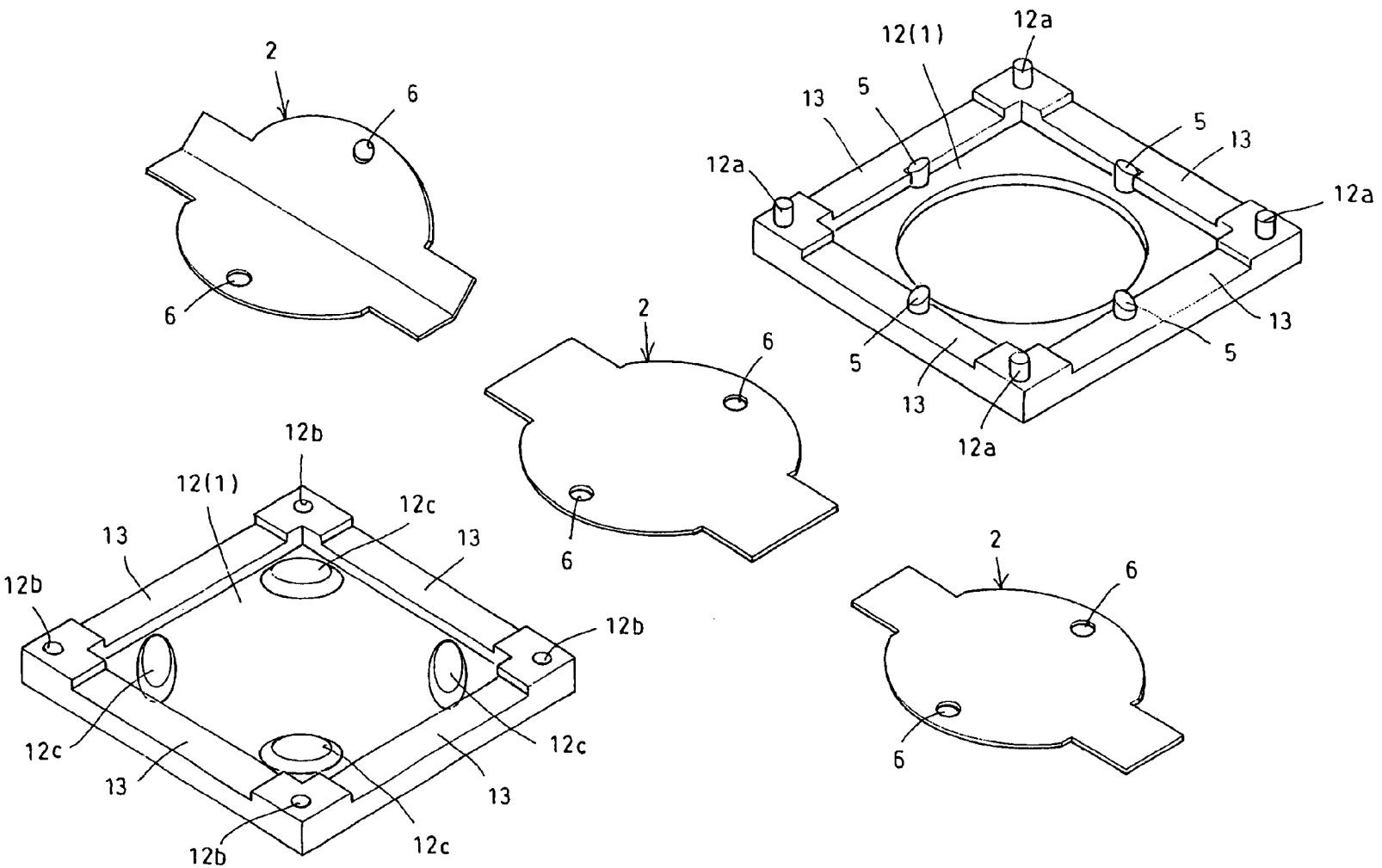
FIG. 19 is a perspective view of block plates and joints according to an eighth embodiment.
Figure 20:
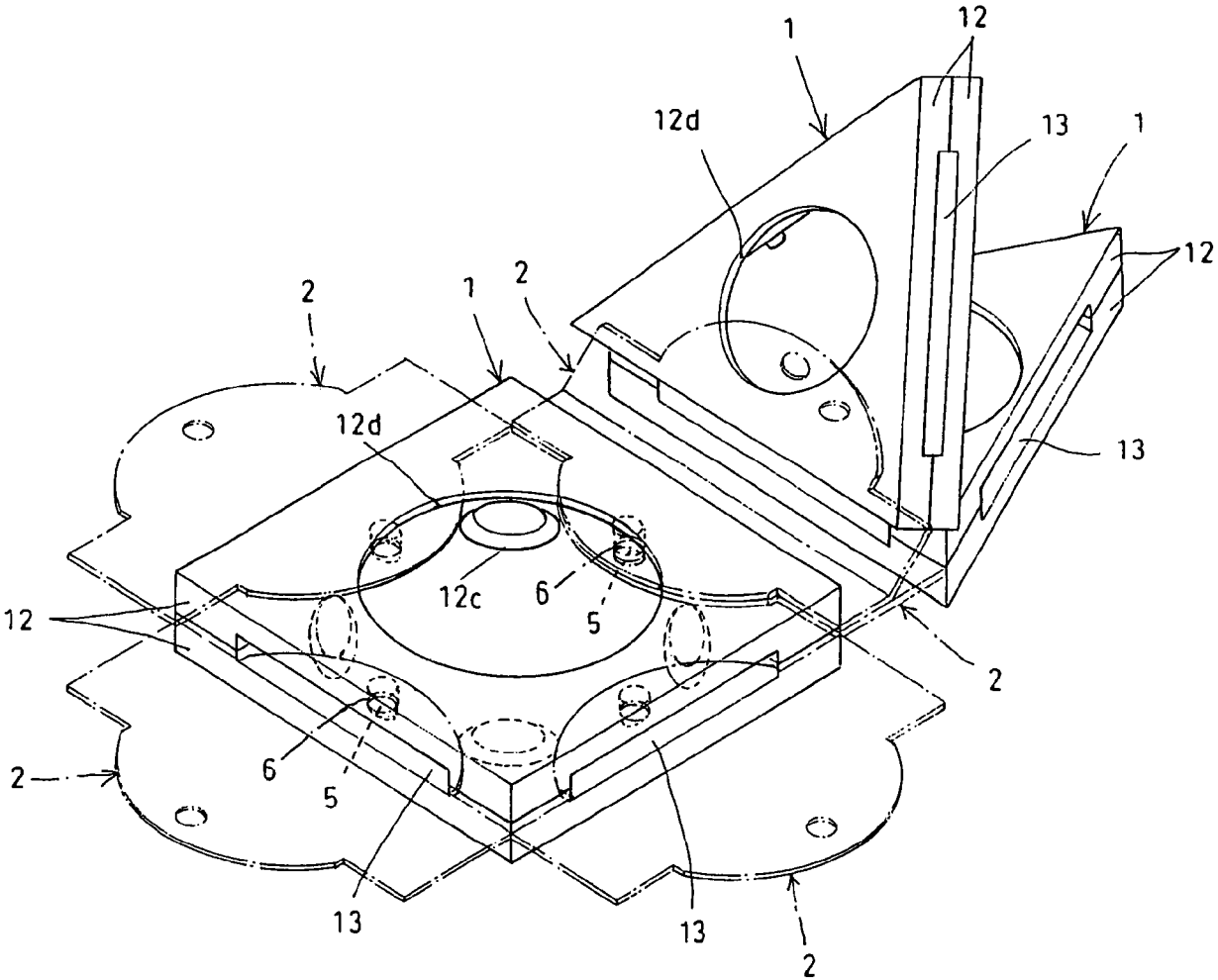
FIG. 20 is a perspective view of the same, showing how they are coupled together in three directions.

In the eighth embodiment shown in FIGS. 19 and 20, the block plate 1 comprises two separate plates 12 integrally laminated together and defining insertion spaces 13 therebetween that open to the respective sides of the block plate 1. By inserting the joint 2 into one of the insertion spaces 13 of each block plate 2, a plurality of block plates 1 can be coupled together.

In this embodiment, preferably, one of the two separate plates 12 is formed with insertion protrusions 12*a* on the back thereof at the respective four corners, and the other is formed with insertion holes 12*b* in the back thereof at the respective corners. With the two plates 12 accurately positioned relative to each other by inserting the respective insertion protrusions 12*a* into the respective insertion holes 12*b*, the plates 12 can be bonded together.

In this block, by suitably setting the size of the openings of the insertion spaces 13, it is possible to easily insert a plurality of joints 2 stacked one on another into one of the insertion spaces 13.

With each side of the joint 2 received inside the block plate 1 such that both surfaces thereof are covered, it is possible to reliably prevent turning up of the joint. Thus, even if only one engaging protrusion 5 is formed on the central portion of each side of the block plate 1 inside each insertion space 13, and only one engaging hole 6 is formed in each side of the joint 2, the engaging protrusion 5 can be reliably retained in the engaging hole 6 without the possibility of inadvertent separation of the protrusion from the hole.

Straight edges at both ends of the joint 2 are adapted to abut the respective side walls of any insertion space 13 of the block plate 1, thereby preventing pivoting of the joint 2. Preferably, pressing protrusions 12*c* are formed on the back of one of the separate plates 12. The pressing protrusions 12*c* support the end edges of the joint 2, thereby further stabilizing the joint 2.

Further preferably, a window 12*d* is formed through one of the separate plates 12. With this arrangement, by inserting a tool such as a screwdriver, and pushing and deflecting the joint 2 with the tool, it is possible to disengage the engaging protrusion 5 from the engaging hole 6, and thus to easily separate joint 2 from the block plate 1.

What is claimed is:

1. An assembling block comprising:

first and second block plates (1) having square and equilateral triangular plan shapes, respectively, and formed of molded plastic; and a joint (2) configured to connect said first and second block plates (1) together;

wherein each of said block plates (1) includes seat portions (3) provided along respective sides of the block plate at both ends of each of the respective sides, each of said seat portions having a step at an inner portion thereof, and retaining pieces (4) extending from a center portion of the block plate to an outer edge thereof;

wherein each of said block plates is provided with a pair of first engagement parts that are spaced apart from one another;

wherein said joint is provided with a first pair of second engagement parts that are spaced apart from one another, and a second pair of second engagement parts that are spaced apart from one another;

wherein said first engagement parts are constituted by one of engagement protrusions and engagement holes;

wherein said second engagement parts are constituted by the other of engagement protrusions and engagement holes;

wherein each of said pairs of first engagement parts are respectively configured and spaced apart so as to be engageable with each of said pairs of second engagement parts;

wherein, for each of said block plates, said first engagement parts are formed at said seat portions thereof;

wherein, for each of said block plates, said retaining pieces are spaced from respective ones of the seat portions (3) in a thickness direction of the respective block plate, such that said joint can be inserted between one of said retaining pieces and a pair of said seat portions; and wherein said first and second block plates and said joint are configured such that, when a first side part of said joint is inserted between a first one of said retaining pieces and a first pair of said seat portions of either one of said first and second block plates, a respective pair of the engagement protrusions engage in a respective pair of the engagement holes and a first side edge of said joint abuts against the steps of said first pair of said seat portions, and when a second side part of said joint is inserted between a second one of said retaining pieces and a second pair of said seat portions of the other one of said first and second block plates, a second pair of the engagement protrusions engage in a second pair of the engagement holes and a second side edge of said joint abuts against the steps of said second pair of said seat portions, such that said first and second block plates are connected together by said joint.

2. The assembling block of claim 1, wherein said joint constitutes a first joint; and said first and second block plates and said first joint are configured such that, in addition to the first side part of said first joint, a first side part of a second joint can also be inserted between said one of said retaining pieces and said first pair of said seat portions of said one of said first and second block plates so that said first block plate can be connected to said second block plate by said first joint, and said first block plate can be connected to a third block plate by the second joint.

3. The assembling block of claim 1, wherein each of said engagement protrusions has a lower height at an outer side thereof than at an inner side thereof such that each of said engagement protrusions has a slanted end face to facilitate insertion of said joint either between said first one of said retaining pieces and said first pair of said seat portions or between said second one of said retaining pieces and said second pair of said seat portions.

4. The assembling block of claim 1, wherein downwardly protruding ribs are respectively provided on undersides of said retaining pieces.

5. The assembling block of claim 1, wherein said first block plate has four of said retaining pieces and eight of said seat portions; and said second block plate has three of said retaining pieces and six of said seat portions.

6. The assembling block of claim 1, wherein said first engagement parts are respectively constituted by said engagement protrusions, and said second engagement parts are respectively constituted by said engagement holes.

* * * * *